US008998207B2

(12) United States Patent
Takasaki et al.

(10) Patent No.: US 8,998,207 B2
(45) Date of Patent: Apr. 7, 2015

(54) IMAGE RECORDING APPARATUS

(75) Inventors: Hironori Takasaki, Ogaki (JP); Quanhe Li, Nagoya-shi (CN)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 13/562,395

(22) Filed: Jul. 31, 2012

(65) Prior Publication Data

US 2013/0033715 A1 Feb. 7, 2013

(30) Foreign Application Priority Data

Aug. 5, 2011 (JP) ..... 2011-171543

(51) Int. Cl.
*B65H 29/22* (2006.01)
*G03G 15/00* (2006.01)
*B41J 13/00* (2006.01)

(52) U.S. Cl.
CPC ..... *G03G 15/6552* (2013.01); *B41J 13/0036* (2013.01); *G03G 15/6573* (2013.01); *G03G 2215/00447* (2013.01); *G03G 2215/00734* (2013.01); *G03G 2215/00742* (2013.01)

(58) Field of Classification Search
USPC ..... 271/314, 82; 399/406, 397; 347/104
See application file for complete search history.

(56) References Cited

U.S. PATENT DOCUMENTS

| | | | | |
|---|---|---|---|---|
| 7,775,619 | B2 * | 8/2010 | Kawabata | 347/16 |
| 8,205,956 | B2 * | 6/2012 | Kawamata et al. | 347/16 |
| 8,292,291 | B2 * | 10/2012 | Amamoto | 271/176 |
| 2012/0099876 | A1 * | 4/2012 | Kikuchi | 399/16 |

FOREIGN PATENT DOCUMENTS

| | | |
|---|---|---|
| JP | 05-024318 A | 2/1993 |
| JP | 2002-036671 A | 2/2002 |

* cited by examiner

*Primary Examiner* — Ernesto Suarez
(74) *Attorney, Agent, or Firm* — Banner & Witcoff, Ltd.

(57) ABSTRACT

An image recording apparatus includes: a recording portion; a sheet conveyor; a detector; and a controller configured to control the sheet conveyor to stop a first-attribute sheet in a state in which the sheet conveyor is nipping the first-attribute sheet when the detector has detected that the first-attribute sheet reaches a first-attribute-sheet stopping position; and to control the sheet conveyor to stop a second-attribute sheet in a state in which the sheet conveyor is nipping the second-attribute sheet when the detector has detected that the second-attribute sheet reaches a second-attribute-sheet stopping position which is located on an upstream side of the first-attribute-sheet stopping position in the conveying direction.

10 Claims, 10 Drawing Sheets

FIG.10

| | |
|---|---|
| FIRST LENGTH (210mm) | POSITION P1 |
| SECOND LENGTH (297mm) | POSITION P2 |

(A)

| | |
|---|---|
| REGULAR PAPER | POSITION P1 |
| CARDBOARD | POSITION P2 |

(B)

| | |
|---|---|
| INK AMOUNT < FIRST THRESHOLD | POSITION P1 |
| INK AMOUNT >= FIRST THRESHOLD | POSITION P3 |

(C)

| | |
|---|---|
| A4-SIZE SHEET | POSITION P1 |
| A3-SIZE SHEET | POSITION P2 |

(D)

IMAGE RECORDING APPARATUS

CROSS REFERENCE TO RELATED APPLICATION

The present application claims priority from Japanese Patent Application No. 2011-171543, which was filed on Aug. 5, 2011, the disclosure of which is herein incorporated by reference to its entirety.

BACKGROUND OF THE INVENTION

1. Field of the Invention

The present invention relates to an image recording apparatus which allows a sheet to stop on a conveying path before the sheet on which an image has been recorded is discharged.

2. Discussion of Related Art

There is known an image recording apparatus which performs an image recording to a sheet conveyed through a conveying path and discharges the image-recorded sheet onto a discharge tray. As an example of the above-mentioned image recording apparatus, (there is known an image recording apparatus which), in a case where a length of a discharged medium (a sheet) is greater than a length of a table (a discharge tray), stops the medium while a pair of rollers nip the medium. This image recording apparatus can prevent the discharged medium from falling from the table.

SUMMARY OF THE INVENTION

However, in the above-mentioned image recording apparatus, following problems occur. In the image recording apparatus, a controller controls a drive mechanism which drives one of the pair of rollers to stop when an upstream end portion of the medium in a discharging direction passes a sensor located on an upstream side of the pair of rollers in the discharging direction. Accordingly, the pair of rollers stop in a state of nipping the upstream end portion of the medium in the discharging direction. In a case where the length of the medium is greater than the length of the table, a portion of the medium protruding from the table is not supported by the table so as to be in a state of being curved and hung down from the table. In the image recording apparatus, since the medium is stopped when the upstream end portion of the medium in the discharging direction passes the sensor, the medium is stopped at a fixed position. In a case where the medium is left at the fixed position in the above-described state, it is possible that the medium remains being curved.

It is therefore an object of the present invention to provide an image recording apparatus which can restrain the sheet from remaining curved even in a case where the image-recorded sheet is stopped on the conveying path.

In order to achieve the above-mentioned object, according to the present invention, there is provided an image recording apparatus, comprising: a recording portion configured to record an image on a sheet conveyed through a conveying path in a conveying direction by ejecting recording material to the sheet; a sheet conveyor disposed at a downstream side of the recording portion in the conveying direction and configured to convey the sheet in the conveying direction while nipping the sheet; a detector configured to detect a position of the sheet conveyed through the conveying path; and a controller configured to: in a case where all parts of image have been recorded on a first-attribute sheet which has a first attribute, control the sheet conveyor to stop the first-attribute sheet in a state in which the sheet conveyor is nipping the first-attribute sheet when the detector has detected that the first-attribute sheet reaches an first-attribute-sheet stopping position where the-first-attribute sheet is to be stopped after all parts of image have been recorded thereon; and in a case where all parts of image have been recorded on a second-attribute sheet which has a second attribute, control the sheet conveyor to stop the second-attribute sheet in a state in which the sheet conveyor is nipping the second-attribute sheet when the detector has detected that the second-attribute sheet reaches an second-attribute-sheet stopping position where the second-attribute sheet is to be stopped after all parts of image have been recorded thereon and which is located on an upstream side of the first-attribute-sheet stopping position in the conveying direction.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIGS. 10A through 10D are explanatory views of data tables.

DETAILED DESCRIPTION OF THE PREFERRED EMBODIMENTS

There will be described embodiments of the invention with reference to the drawings. Hereinafter, there will be described a Multifunction Device (MFD) 1 as a first embodiment. The present invention is not limited to the illustrated embodiments. It is to be understood that the present invention may be embodied with various changes and modifications that may occur to a person skilled in the art, without departing from the spirit and scope of the invention defined in the appended claims. Further, hereinafter, an orientation going from a starting point of an arrow to an ending point thereof is referred to as a direction, and orientations coming and going (of a reciprocation) on a line connecting between the starting point and the ending point of the arrow are referred to as directions. Furthermore, hereinafter, based on a state in which the MFD 1 is installed in use (a state shown in FIG. 1), up-down directions 14 are defined, front-rear directions 12 are defined as a portion on which an operation panel 4 is located is a near portion (a front portion), and left-right directions 13 are defined as the MFD 1 is seen from the near portion (front portion).

[MFD 1]

Figure 1:
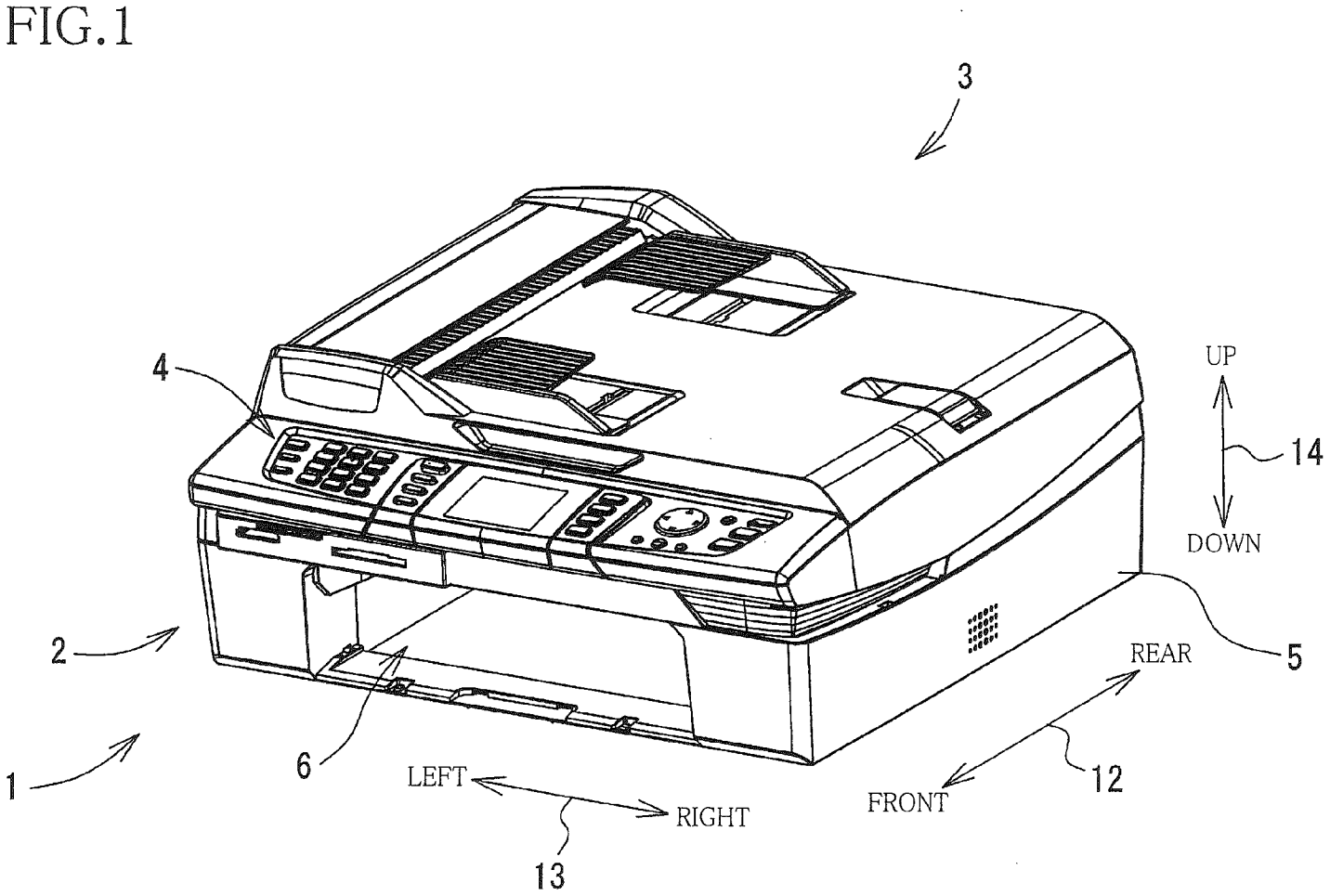
FIG. 1 is a perspective view showing an appearance of a Multifunction Device (MFD) as a first embodiment of an image recording apparatus to which the present invention is applied.

There will be described an appearance of a Multifunctional Device (MFD) 1 with reference to FIG. 1. As shown in FIG. 1, the MFD 1 has a generally rectangular parallelepiped shape. The MFD 1 includes a printer portion 2 (shown in FIG. 2; an example of an image recording apparatus) located in a lower portion thereof and a scanner portion 3 located in an upper portion thereof. The MFD 1 has a printer function, a scanner function, a copier function, a facsimile machine function, and so on. The functions except the printer function can be varied at will. For example, an image recording apparatus to which the present invention is applied may be embodied as a printer having the printer function only, in which the scanner portion 3 is omitted.

The printer portion 2 records an image on a recording sheet 19 (shown in FIG. 2) based on print data outputted from an external information device such as a computer. The printer portion 2 includes a casing 5 having an opening 6 formed on a front surface thereof. Inside of the opening 6, a sheet-supply tray 20 and a sheet-discharge tray 21 are disposed in two-tiers. The sheet-supply tray 20 and the sheet-discharge tray 21 can be attached to and detached from the MFD 1 through the opening 6. In the casing 5, there are disposed other composing elements of the printer portion 2 in addition to the sheet-supply tray 20 and the sheet-discharge tray 21. The composing elements include a conveying path 23, a recording portion 24 (an example of a recording portion), and so forth.

The scanner portion 3 is formed as a so-called flat-bed scanner. A detailed explanation of the scanner portion 3 is omitted. On an upper surface on a front portion of the scanner portion 3, there is disposed an operation panel 4 for operating the printer portion 2 and the scanner portion 3.

[Sheet-Supply Tray 20 and Sheet-Discharge Tray 21]

Figure 2:
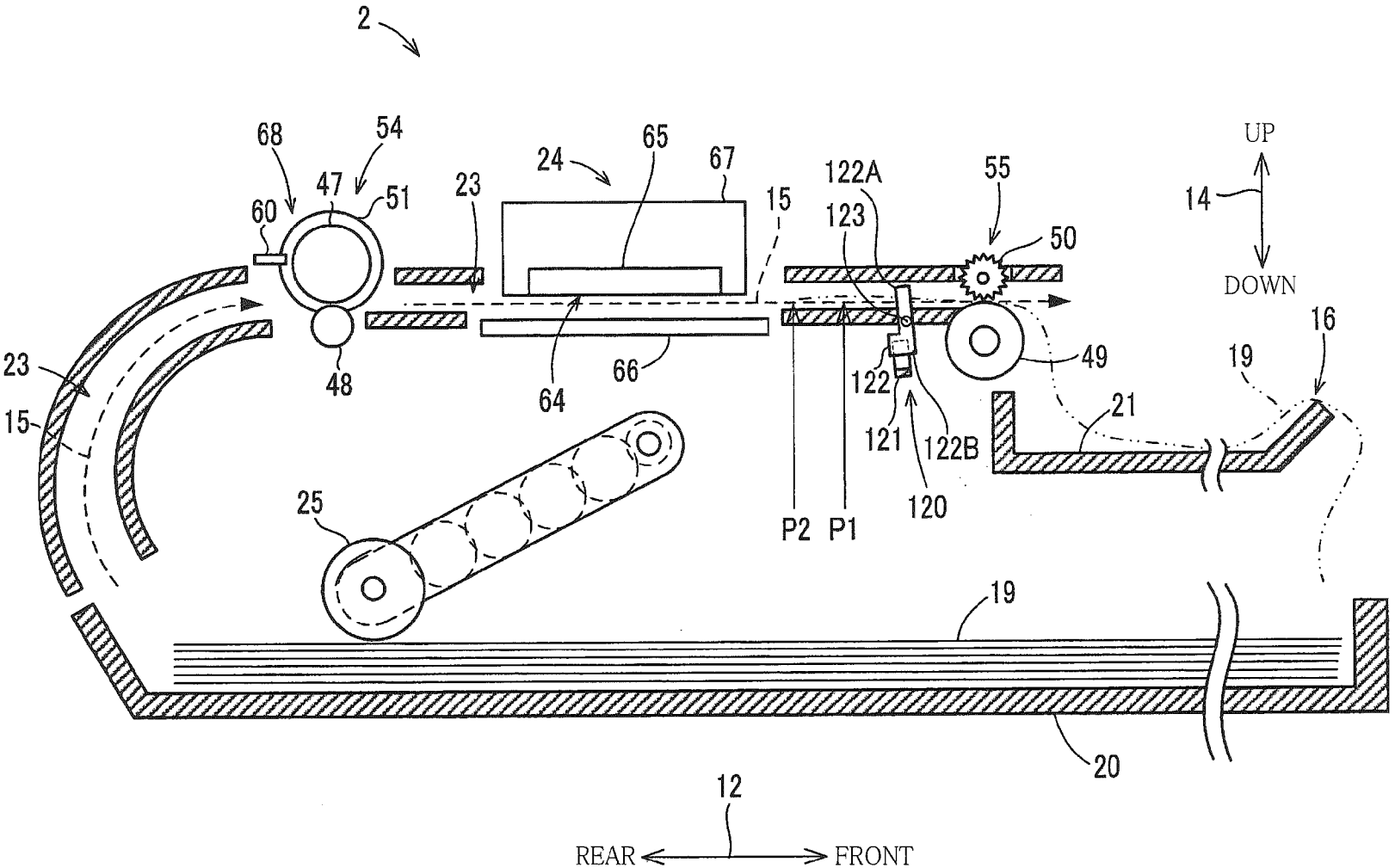
FIG. 2 is a side cross-sectional view schematically showing an internal structure of a printer portion of the MFD.

As shown in FIG. 2, the sheet-supply tray 20 is located below the recording portion 24 in a state in which the sheet-supply tray 20 is attached to the printer portion 2. The sheet-supply tray 20 has a generally rectangular dish shape extending in attaching-detaching directions (the front-rear directions 12 in the present embodiment) in plan view. A plurality of recording sheets 19 of desired sizes such as A4-size, A3-size, or the like are accommodated in the sheet-supply tray 20. In the state in which the sheet-supply tray 20 is attached to the printer portion 2, the recording sheet 19 accommodated in the sheet-supply tray 20 can be supplied to the conveying path 23 (an example of a conveying path).

The recording sheet 19 is supplied from the sheet-supply tray 20 to the conveying path 23. After an image is recorded on the recording sheet 19 supplied to the conveying path 23 by the recording portion 24, the recording sheet 19 is then discharged onto an upper surface of the sheet-discharge tray 21 (an example of a discharge tray). The discharged recording sheet 19 from the printer portion 2 is placeable on the sheet-discharge tray 21. The sheet-discharge tray 21 is located above the sheet-supply tray 20.

Though, in the present embodiment, the recording sheet 19 is supplied from the sheet-supply tray 20, the recording sheet 19 may be supplied from another portion. For example, in a case where a manual tray is disposed on a back surface or a rear end portion of the printer portion 2, the recording sheet 19 may be supplied from the manual tray.

[Sheet-Supply Roller 25]

As shown in FIG. 2, there is disposed a sheet-supply roller 25 above the sheet-supply tray 20. The sheet-supply roller 25 is rotated by a drive transmitted from a sheet-supply motor 76 (shown in FIG. 3). Accordingly, an uppermost one of the plurality of recording sheets 19 accommodated in the sheet-supply tray 20 is supplied to the conveying path 23.

[Conveying Path 23]

As shown in FIG. 2, the conveying path 23 extends from an upper portion of a rear end portion of the sheet-supply tray 20. The recording sheet 19 accommodated in the sheet-supply tray 20 is guided in a U-turn manner from a lower portion to an upper portion through the conveying path 23 to the recording portion 24. An image recording is performed on the recording sheet 19 by the recording portion 24, and then, the recording sheet 19 is discharged onto the sheet-discharge tray 21.

Hereinafter, a description will be made, in which a direction (a direction indicated by a broken arrow in FIG. 2) in which the recording sheet 19 is conveyed through the conveying path 23 during a recording operation by the recording portion 24 is defined as a first direction 15 (an example of a conveying direction).

[Conveyor Rollers 54 and Discharge Rollers 55]

As shown in FIG. 2, on an upstream side of the recording portion 24 in the first direction 15, there are disposed conveyor rollers 54 which consist of a conveyor roller 47 and a pinch roller 48. The pinch roller 48 is held in pressure contact with a roller surface of the conveyor roller 47 by an elastic member such as spring. Thus, the conveyor rollers 54 can nip the recording sheet 19.

On a downstream side of the recording portion 24 in the conveying path 23 in the first direction 15 and on an upstream side of the sheet-discharge tray 21 in the conveying path 23 in the first direction 15, there are disposed discharge rollers 55 (an example of a sheet conveyor) which consist of a discharge roller 49 and a spur 50. The spur 50 is held in pressure contact with a roller surface of the discharge roller 49 by an elastic member such as spring. Thus, the discharge rollers 55 can nip the recording sheet 19.

The conveyor roller 47 and the discharge roller 49 are driven by a rotary drive force of a conveyor motor 59 (shown in FIG. 3) transmitted via a drive transmission mechanism. The drive transmission mechanism consists of a planetary gear and so on. For example, in a case where the conveyor motor 59 is rotated in a normal direction, the recording sheet 19 is conveyed in the first direction 15, on the other hand, in a case where the conveyor motor 59 is rotated in a reverse direction, the recording sheet 19 is conveyed in a second direction opposite to the first direction 15.

The conveyor rollers 54 nip the recording sheet 19 and convey the same 19 in the first direction 15. The recording sheet conveyed in the first direction 15 is guided onto a platen 66. The platen 66 is disposed below the recording portion 24 to be opposed to the recording portion 24 and supports the recording sheet 19 conveyed along the conveying path 23. The discharge rollers 55 nip the recording sheet 19 on which an image has been recorded on the platen 66 and convey the same 19 in the first direction 15 and the second direction. The recording sheet 19 conveyed in the first direction 15 is guided onto the sheet-discharge tray 21.

[Rotary Encoder 68]

As shown in FIG. 2, there is disposed a rotary encoder 68 for detecting a rotation amount of the conveyor roller 47. The rotary encoder 68 consists of an encoder disc 51 that is coaxial with the conveyor roller 47 so as to be rotated along with the conveyor roller 47, and an optical sensor 60. The encoder disc 51 has a pattern in which a transmitting portion (a transparent portion) through which a light is transmitted and a non-transmitting portion (an opaque portion) through which no light is transmitted are alternately arranged in a circumferential direction at equal pitches. When the encoder disc 51 is rotated with the conveyor roller 47, a pulse signal is generated every time the optical sensor 60 detects the transmitting portion and the non-transmitting portion of the rotary encoder 68. The pulse signal generated by the optical sensor 60 is outputted to a controller 130 described later.

[Recording Portion 24]

The recording portion 24 is an inkjet-type recording portion which records an image on the recording sheet 19. As shown in FIG. 2, the recording portion 24 includes a carriage 67 which carries a recording head 65 and reciprocates in main scanning directions (directions perpendicular to a sheet plane of FIG. 2, i.e., the left-right directions 13). To the recording head 65, colors of inks including cyan (C), magenta (M), yellow (Y), and black (Bk) are supplied from ink cartridges (not shown). The recording head 65 ejects the respective inks as tiny droplets of ink from nozzles 64 formed in a lower surface of the recording head 65. By a reciprocating movement of the carriage 67 in the main scanning directions (the left-right directions 13), the recording head 65 is scanned relative to the recording sheet 19. In the lower surface of the recording head 65, a plurality of nozzles 64 are formed in the first direction 15.

An image is thus recorded on the recording sheet 19 conveyed on the platen 66 along the conveying path 23 in the first direction 15. Instead of the inkjet-type, for example, the recording portion 24 may be of an electrophotographic-type.

[Discharge-Detecting Portion 120]

As shown in FIG. 2, the printer portion 2 includes a discharge-detecting portion 120 for detecting a position of the recording sheet 19 conveyed through the conveying path 23. The discharge-detecting portion 120 is located between the recording portion 24 and the discharge rollers 55 in the conveying path 23. The discharge-detecting portion 120 may be located between the discharge rollers 55 and the sheet-discharge tray 21. The controller 130 described later and the discharge-detecting portion 120 shows an example of a detector.

The discharge-detecting portion 120 consists of, for example, a rotating body 122 including detectors 122A, 122B and a shaft 123, and an optical sensor 121 including a photo-interrupter having a light-emitting element (e.g., a light-emitting diode) and a light-receiving element (e.g., a phototransistor) which receives a light emitted from the light-emitting element. The rotating body 122 is rotatable about the shaft 123. The detector 122A protrudes toward the conveying path 23. In a state in which no external force is applied to the rotating body 122, the detector 122B penetrates into a light path from the light-emitting element of the optical sensor 121 to the light-receiving element thereof so as to block (intercept) a light passing through the light path. When the detector 122A is pushed and rotated by an (leading) end of the recording sheet 19, the detector 122B is out of the light path such that a light passes through the light path.

[Controller 130]

Figure 3:
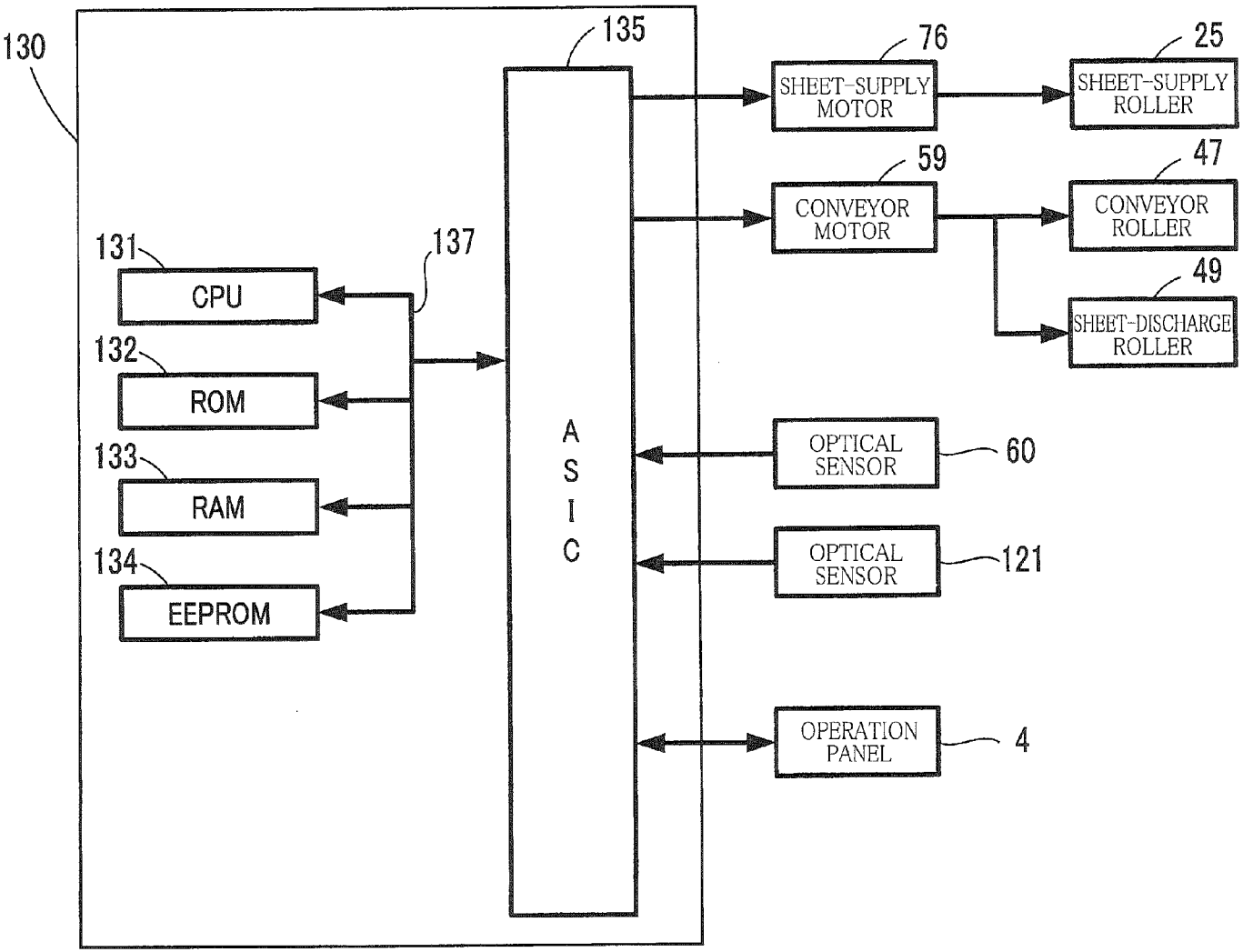
FIG. 3 is a block diagram showing a structure of a controller of the MFD.

Referring next to FIG. 3, a structure of the controller 130 will be generally described. The controller 130 controls overall operations of the MFD 1. The present invention is realized by executing a stop control of the recording sheet 19 by the controller 130 according to a flow chart described below. The controller 130 includes a CPU 131, a ROM 132, a RAM 133, an EEPROM 134, an ASIC 135 and an internal bus connecting therebetween.

In the ROM 132, there are stored programs for control by the CPU 131 of various operations including the stop control described later. The RAM 133 functions as a memory (storage) area for temporarily storing data, signals, and the like used at the time of executing the above-mentioned programs. The EEPROM 134 stores settings, flags and so forth that should be kept stored after a power turns off.

To the ASIC 135, there are connected the sheet-supply motor 76, the conveyor motor 59, the optical sensor 60 of the rotary encoder 68, the optical sensor 121 of the discharge-detecting portion 120, the operation panel 4, and so on. The ASIC 135 incorporates drive circuits to control various motors. When a drive signal for rotating each motor is inputted to a drive circuit corresponding to each motor from the CPU 131, a drive current according to the drive signal is outputted from the drive circuit to the corresponding motor. Therefore, the corresponding motor makes a normal rotation or a reverse rotation at a certain rotation speed.

When an image recording on a piece of the recording sheet 19 is finished by the recording portion 24, in a state in which the recording sheet 19 is nipped by only the discharge rollers 55, the controller 130 controls the conveyor motor 59 to stop a rotation of the discharge roller 49. Accordingly, the recording sheet 19 on which the image recording is finished by the recording portion 24 is stopped in a state of being nipped by only the discharge rollers 55. As a result, the recording sheet 19 is not discharged onto the sheet-discharge tray 21 until the discharge roller 49 is rotated again by the controller 130.

The optical sensor 121 outputs an electric signal (a voltage signal or a current signal) according to an intensity of light received by the light-receiving element. The outputted signal is inputted to the controller 130. The controller 130 determines whether an electric level (a voltage amount or a current amount) of the inputted signal is equal to or greater than a predetermined threshold amount. In a case where the inputted signal is equal to or greater than the predetermined threshold amount, the signal is determined as a HIGH-level signal, while, in a case where the inputted signal is smaller than the predetermined threshold amount, the signal is determined as a LOW-level signal. The controller 130 thus determines an existence of the recording sheet 19 by the discharge-detecting portion 120.

For example, in a case where the inputted signal from the optical sensor 121 is determined as the HIGH-level signal, the recording sheet 19 exists at a position in the conveying path 23 where the discharge-detecting portion 120 is located. At the time, the detector 122B is out of the light path between the light-emitting element and the light-receiving element. On the other hand, in a case where the inputted signal from the optical sensor 121 is determined as the LOW-level signal, no recording sheet 19 exists at a position in the conveying path 23 where the discharge-detecting portion 120 is located. At the time, the detector 122B protrudes into the light path between the light-emitting element and the light-receiving element.

Further, the controller 130 counts a pulse of a pulse signal from the optical sensor 60, from a time point when the LOW-level signal inputted from the optical sensor 121 is turned into the HIGH-level, to a time point when the HIGH-level signal inputted from the optical sensor 121 is turned into the LOW-level. The time point when the LOW-level signal turns into the HIGH-level signal represents a time point when the (leading) end of the recording sheet 19 in the first direction 15 passes the discharge-detecting portion 120. The time point when the High-level signal turns into the LOW-level signal represents a time point when a rear or a trailing end of the recording sheet, 19 in the first direction 15 passes the discharge-detecting portion 120. The optical sensor 60 can detect a position of the leading end of the recording sheet 19 being conveyed based on a number of counts from the optical sensor 60.

[ROM 132 and EEPROM 134]

At least one of the ROM 132 and the EEPROM 134 store stopping positions of the recording sheet 19 corresponding to respective attributes of the plurality of recording sheets 19. The attributes of the recording sheets 19 and the stopping positions corresponding to the respective attributes thereof are stored in the form of, e.g., data table.

In the present embodiment, the attribute of the recording sheet 19 consists of information about a length of the recording sheet 19 in the first direction 15. The length of the recording sheet 19 in the first direction 15 is a length of the recording sheet 19 placed on the sheet-supply tray 20 in the front-rear directions 12. For example, in a case where the recording sheet 19 is placed on the sheet-supply tray 20 in a state in which directions parallel to two short-sides of a rectangular shape of the recording sheet 19 are parallel to the front-rear directions 12, a first length (an example of a first attribute) of the A4-size recording sheet 19 as the recording sheet 19 in the first direction 15 is 210 mm, and a second length (an example of a second attribute) of the A3-size recording sheet 19 as the recording sheet 19 in the first direction 15 is 297 mm. In other words, the first length of the A4-size recording sheet (an example of a first-attribute sheet) as the recording sheet 19 in the first direction 15 which has the first attribute is smaller than the second length of the A3-size recording sheet (an example of a second-attribute sheet) as the recording sheet 19 in the first direction 15 which has the second attribute. The first attribute and the second attribute are different in attribute, i.e., the first attribute and the second attribute may have physical amounts indicating the same property (length, weight, and so on), may have different physical amounts, or may have physical amounts indicating properties different from each other.

Further, in the present embodiment, a stopping position of the recording sheet 19 (an example of a first-attribute-sheet stopping position) is a stopping position after all parts of image have been recorded on a piece of recording sheet 19 whose attribute is the first attribute. That all parts of image have been recorded on the piece of recording sheet 19 whose attribute is the first attribute means that all parts of image to be recorded have been recorded on an image recording face of the piece of recording sheet 19 having the first attribute. Furthermore, in the present embodiment, the stopping position indicates a stopping position of an upstream end of the recording sheet 19 in the first direction 15, but a stopping position is not limited to this: When the recording sheet 19 is stopped at the above-mentioned stopping position, a downstream end of the recording sheet 19 in the first direction 15 (the leading end of the recording sheet 19 in the first direction 15) is positioned on a downstream side of a nipping position of the recording sheet 19 by the discharge rollers 55 in the first direction 15. Further, when the recording sheet 19 is stopped at the stopping position, the upstream end of the recording sheet 19 in the first direction 15 (the trailing end of the recording sheet 19 in the first direction 15) is positioned on an upstream side of the nipping position of the recording sheet 19 by the discharge rollers 55 in the first direction 15. That is, when the recording sheet 19 is stopped at the stopping position, the recording sheet 19 is in a nipping state of being nipped by the discharge rollers 55.

For example, in the present embodiment, as shown in FIG. 10A, in a case where a length in the first direction 15 of the piece of recording sheet 19 on which all parts of image have been recorded is the first length (210 mm), the upstream end of the recording sheet 19 in the first direction 15 is stopped at a position P1 (shown in FIG. 2). A position of the recording sheet 19 in a case where the upstream end of the recording sheet 19 having the first attribute in the first direction 15 is positioned at the position P1 (the position of the recording sheet 19, hereinafter, referred to as a first position) is an example of a first-attribute-sheet stopping position.

Further, in a case where a length in the first direction 15 of the piece of recording sheet 19 having the second attribute on which all parts of image have been recorded is the second length (297 mm), the upstream end of the recording sheet 19 having the second attribute in the first direction 15 is stopped at a position P2 (shown in FIG. 2) that is located on an upstream side of the position P1 in the first direction 15. A position of the recording sheet 19 in a case where the upstream end of the recording sheet 19 having the second attribute in the first direction 15 is positioned at the position P2 (the position of the recording sheet 19, hereinafter, referred to as a second position) is an example of a second-attribute-sheet stopping position.

In other words, the first position is a stopping position of the recording sheet 19 in a case where the attribute of the recording sheet 19 belongs to the first attribute, and the second position is a stopping position of the recording sheet 19 in a case where the attribute of the recording sheet 19 belongs to the second attribute.

As mentioned above, in the present embodiment, as shown in FIG. 10A, the first length and the position P1 corresponding to the first length, and the second length and the position P2 corresponding to the second length are stored as data table. Thus, at least one of the ROM 132 and the EEPROM that store the data table is an example of a stopping-position storage. Instead of the positions P1 and P2 corresponding to the first and second lengths, for example, as shown in FIG. 10D, the position P1 corresponding to an A4-size sheet and the position P2 corresponding to an A3-size sheet may be stored in the data table.

[RAM 133]

In the RAM 133, the attributes of the recording sheet 19 are stored. The attribute of the recording sheet 19 is specified by an operation of the operation panel 4 by a user. For example, names of sizes (A4, A3 and so on) of the recording sheets 19 and the lengths of the recording sheets 19 in the first direction 15 corresponding to the respective names of sizes thereof are stored in advance as the data table in the ROM 132 or the EEPROM 134. The user operates the operation panel 4 to specify the name of size of the recording sheet 19 such as A4-size or A3-size. The controller 130 obtains the length of the recording sheet 19 in the first direction 15 corresponding to the specified name of size of the recording sheet 19 with reference to the data table. Then, the obtained length of the recording sheet 19 in the first direction 15 is stored in the RAM 133 as the attribute of the recording sheet 19 on which an image is going to be recorded by the recording portion 24. The RAM 133 in which the length of the recording sheet 19 in the first direction 15 is stored as the attribute is an example of an attribute—storage.

The length of the recording sheet 19 in the first direction 15 may not be specified by operating of the operation panel 4 by the user. For example, as mentioned above, the controller 130 may calculate the length of the recording sheet 19 in the first direction 15 based on signals from the optical sensors 60, 121. For example, a detecting portion having the same structure as the discharge-detecting portion 120 is located on an upstream side of the pair of conveyor rollers 54 in the first direction 15 in the conveying path 23. The length of the recording sheet 19 in the first direction 15 is calculated by the number of counts of the optical sensor 60 counted from the detected timing of the downstream end to the detected timing of the upstream end of the recording sheet 19 in the first direction 15 detected by an optical sensor of the detecting portion.

[Stop Control]

In the printer portion 2 structured in the above-described way, the controller 130 executes the stop control of the recording sheet 19, in which the recording sheet 19 is stopped after the image recording thereon is completed. Hereinafter, a processing procedure of the stop control will be described with reference to the flow chart of FIG. 4.

Prior to an execution of the stop control by the controller 130, the MFD 1 receives the size of the recording sheet 19 specified by the user (in the present embodiment, the A4-size or the A3-size). The size of the recording sheet 19 to be recorded is specified by operating of the operation panel 4 by the user.

Then, the user inputs a command to the MFD 1 via the operation panel 4 that the image recording should be performed on the recording sheet 19 accommodated in the sheet-supply tray 20. The controller 130 then starts the execution of the flow chart shown in FIG. 4. First, the controller 130 controls the RAM 133 to store the length of the recording sheet 19 in the first direction 15, i.e., the attribute of the recording sheet 19, which is specified by the user (step SA1; hereinafter "step" is omitted where appropriate).

The controller 130 then drives the sheet-supply motor 76 to rotate the sheet-supply roller 25. By a rotation of the sheet-supply roller 25, the recording sheet 19 accommodated in the sheet-supply tray 20 is conveyed toward the pair of conveyor rollers 54 along the conveying path 23 (SA2).

The controller 130 drives the conveyor motor 59 to rotate the conveyor roller 47. When the recording sheet 19 reaches the pair of conveyor rollers 54, the recording sheet 19 is conveyed toward right below the recording head 65 in a state of being nipped by the pair of conveyor rollers 54 (SA3).

When the recording sheet 19 reaches right below the recording head 65, the controller controls the carriage 67 to move in the left-right directions 13 and eject the ink droplets (SA4). The controller 130 alternately repeats conveying of the recording sheet 19 at a predetermined linefeed width (SA3) and ejecting of the ink droplets (SA4) until the whole image recording on the recording sheet 19 is finished (SA5: YES). The image recording on the piece of recording sheet 19 is thus implemented.

When the image recording on the piece of recording sheet 19 is completed (SA5: YES), the controller 130 performs a discharge operation of the recording sheet 19 (SA6). As described in detail, when the recording sheet 19 conveyed by the pair of conveyor rollers 54 reaches the discharge rollers 55, the recording sheet 19 is conveyed toward the sheet-discharge tray 21 in a state of being nipped by the discharge rollers 55.

The controller 130 collates the length of the recording sheet 19 in the first direction 15 stored in the RAM 133 in SA1 with the data table shown in FIG. 10A. In a case where the length of the recording sheet 19 in the first direction 15 is a length (210 mm) corresponding to the A4-size (SA7: A4), the controller 130 controls the conveyor motor 59 to stop the recording sheet 19 in the state of being nipped by the discharge rollers 55 at the first position, when the upstream end of the recording sheet 19 in the first direction 15 reaches the position P1 (SA8). The controller 130 judges the position of the recording sheet 19 based on the signals from the optical sensors 60, 121. In other words, the controller 130 judges that the leading end of the recording sheet 19 reaches the discharge-detecting portion 120 based on the signal inputted from the optical sensor 121, and calculates a conveying distance of the recording sheet 19 after reaching the discharge-detecting portion 120 based on the signal inputted from the optical sensor 60.

On the other hand, in a case where the length of the recording sheet 19 in the first direction 15 is a length (297 mm) corresponding to the A3-size (SA7: A3), the controller 130 controls the conveyor motor 59 to stop the recording sheet 19 in the state of being nipped by the discharge rollers 55 at the second position, when the upstream end of the recording sheet 19 in the first direction 15 reaches the position P2 (SA9).

In the present embodiment, the positions P1, P2 are located on an upstream side of the discharge-detecting portion 120 in the first direction 15. Accordingly, the discharge-detecting portion 120 can detect the recording sheet 19 stopped at the positions P1, P2. As mentioned above, processing of SA7 through SA9 is an example of a controller.

Then, the user draws out the recording sheet 19 nipped by the discharge rollers 55 (SA10: YES). A series of the stop control is thus ended.

Effects of the First Embodiment

In the present embodiment, a position at which the recording sheet is stopped can be variably determined. For example, the recording sheet 19 whose length in the first direction 15 is short so as to be hardly curved or bent is stopped at the first position, while the recording sheet 19 whose length in the first direction 15 is long so as to be easily curved is stopped at the second position that is located on the upstream side of the first position in the first direction 15. Therefore, when the recording sheet 19 that is easy to be bent is stopped while being nipped by the discharge rollers 55, the recording sheet 19 is not stopped at the same position but is stopped at a position that is variably determined. As a result, the recording sheet 19 is restrained from remaining curved.

Further, in a case where the recording sheet 19 in the state of being nipped by the discharge rollers 55 is stopped at the same position, e.g., the first position, the longer the length of the recording sheet 19 in the first direction 15 is, the larger a part of the recording sheet 19 protruding from the MFD 1 becomes. Consequently, the recording sheet 19 is easy to remain curved. As mentioned above, in the present embodiment, the recording sheet 19 whose length in the first direction 15 is relatively longer is stopped at the second position that is located on the upstream side of the first position in the first direction 15. Accordingly, a part of the recording sheet 19 protruding from the MFD 1 is smaller than, e.g., that in a case where the recording sheet 19 is stopped at the first position. As a result, the recording sheet 19 is restrained from remaining curved.

Modified Example 1 of First Embodiment

In the illustrated embodiment, the attribute of the recording sheet 19 is information about the length of the recording sheet 19 in the first direction 15, but the attribute of the recording sheet 19 may be other information. For example, the attribute of the recording sheet 19 may be information about weight per unit area of the image-recording face of the recording sheet 19.

In a modified example 1, the weight per unit area of the image-recording face of the recording sheet 19 is judged depending on whether the recording sheet 19 is a regular paper or a cardboard that is greater in thickness than the regular paper. For example, the weight per unit area of the regular paper is a first weight (an example of the first attribute), and the weight per unit area of the cardboard is a second weight (an example of the second attribute) that is greater than the first weight. In other words, the first weight of the recording sheet 19 having the first attribute (the regular paper) is smaller than the second weight of the recording sheet 19 having the second attribute (the cardboard).

In the modified example 1, in a case where the recording sheet 19 on which all parts of image has been recorded is the regular paper, the upstream end of the recording sheet 19 in the first direction 15 is stopped at the position P1 (shown in FIG. 2). Further, in a case where the recording sheet 19 on which all parts of image has been recorded is the cardboard, the upstream end of the recording sheet 19 in the first direction 15 is stopped at the position P2 (shown in FIG. 2). As mentioned above, in the modified example 1, as shown in FIG. 10B, information that the recording sheet 19 is the regular paper and the position P1 corresponding to the information, and information that the recording sheet 19 is the cardboard and the position P2 corresponding to the information are stored in at least one of the ROM 132 and the EEPROM 134 as the data table.

Figure 4:
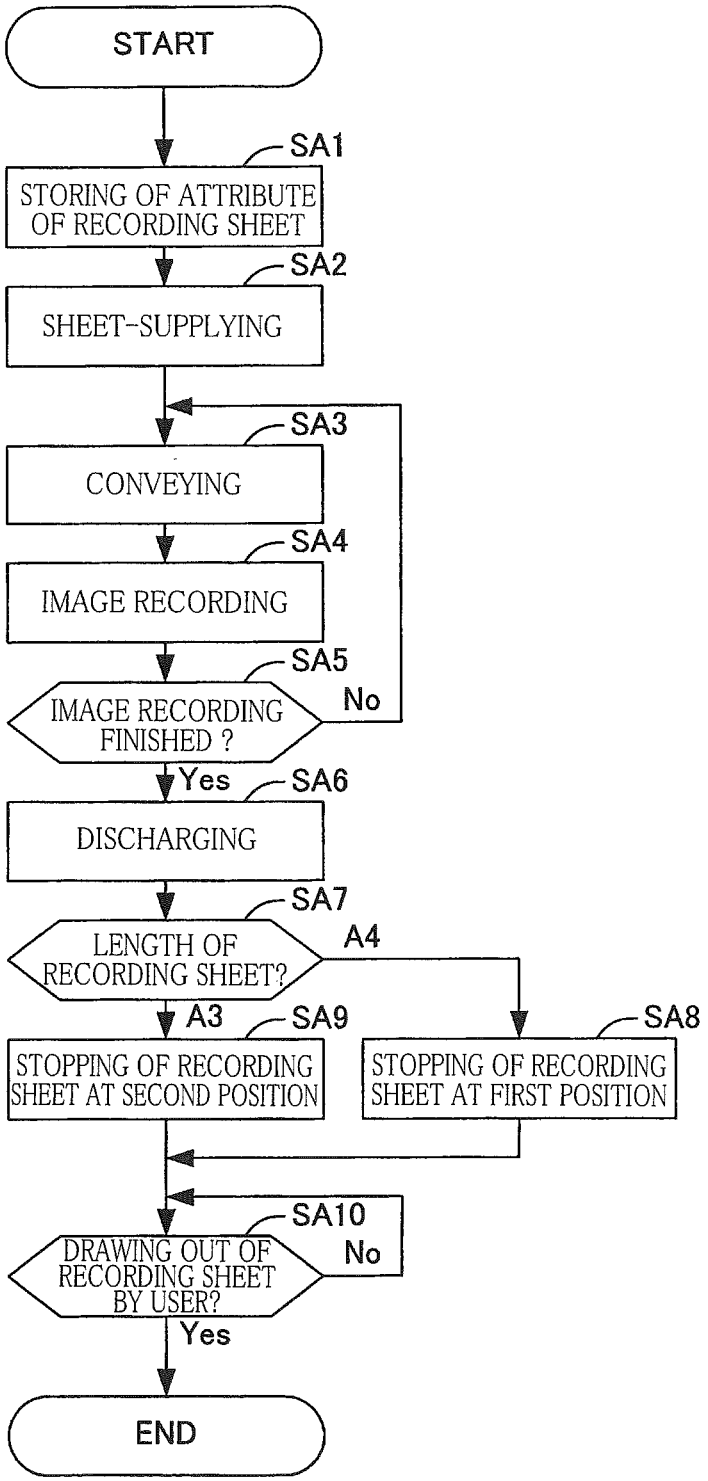
FIG. 4 is a flow chart for explaining a stop control in the first embodiment.
Figure 5:
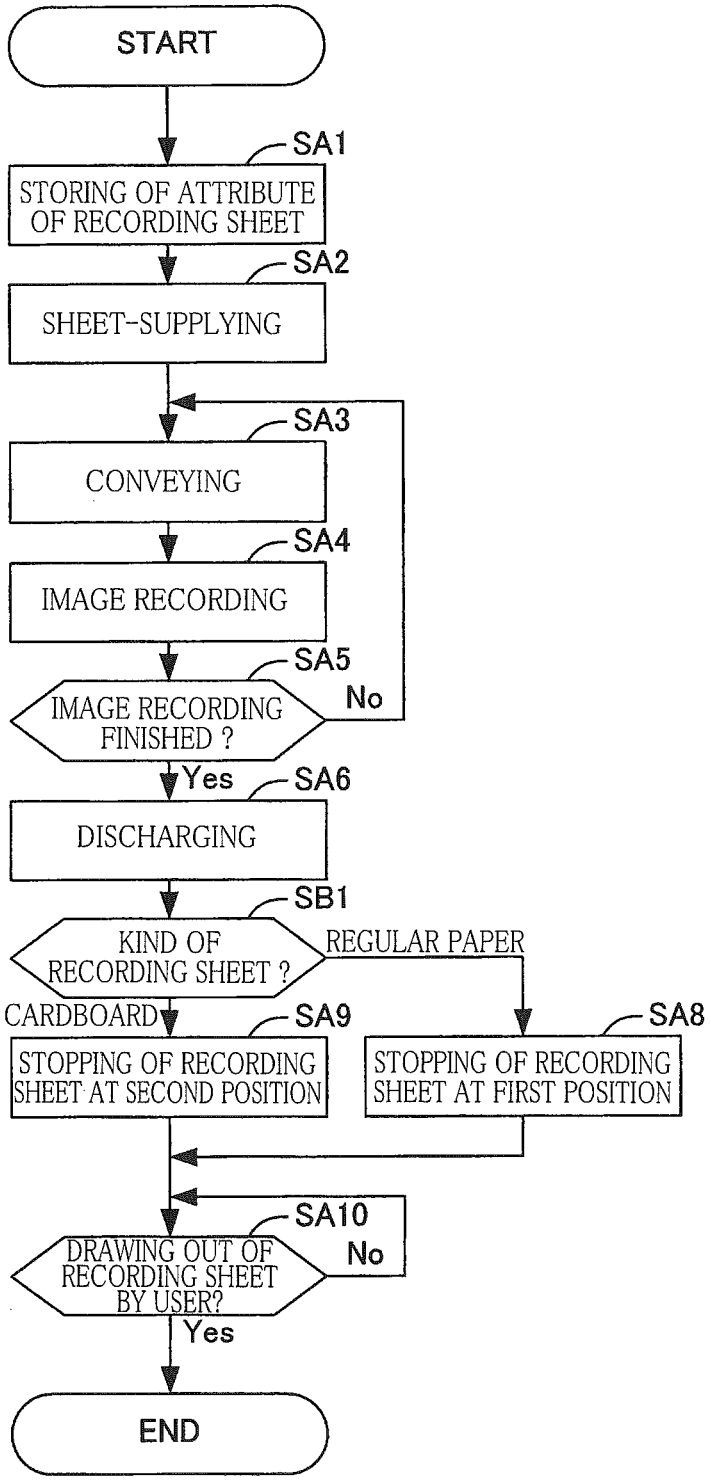
FIG. 5 is a flow chart for explaining a stop control in a modified example 1 of the first embodiment.

Hereinafter, a processing procedure of a stop control in the modified example 1 will be explained with reference to a flow chart of FIG. 5. In a description below, only processing different from the flow chart of FIG. 4 will be described, and a detailed description of processing identical with the flow chart of FIG. 4 will be omitted.

Prior to an execution of the stop control by the controller 130, the MFD 1 receives the size of the recording sheet 19 (in the present example, the regular paper or the cardboard) specified by the user. By operating of the operation panel 4 by the user, a kind of the recording sheet 19 to be recorded is specified. When the user then inputs a command to the MFD 1 via the operation panel 4 that the image recording should be performed on the recording sheet 19 accommodated in the sheet-supply tray 20, the controller 130 starts the execution of the flow chart shown in FIG. 5. First, the controller 130 stores in the RAM 133 the weight per unit area of the image-recording face of the recording sheet 19 specified by the user, i.e., the attribute of the recording sheet 19 (SA1).

After the discharge operation of the recording sheet 19 is performed (SA6), the controller 130 collates the kind of the recording sheet 19 stored in the RAM 133 in SA1 with the data table shown in FIG. 10B. In a case where the recording sheet 19 is the regular paper (SB1: REGULAR PAPER), the controller 130 stops the recording sheet 19 at the first position (SA8). On the other hand, in a case where the recording sheet 19 is the cardboard (SB1: CARDBOARD), the controller 130 stops the recording sheet 19 at the second position (SA9). As mentioned above, processing of SB1, SA8 and SA9 is an example of a controller.

Hereinafter, an effect of the modified example 1 will be explained. In a case where the recording sheet 19 in the state of being nipped by the discharge rollers 55 is stopped at the same position, e.g., the first position, as the weight of the recording sheet 19 is larger, a portion of the recording sheet 19 protruding from the MFD 1 is more easily hung from the MFD 1. Consequently, the recording sheet 19 is easy to remain curved. In the modified example 1, because the recording sheet 19 whose weight is relatively larger is stopped at the second position that is located on the upstream side of the first position in the first direction 15, a portion of the recording sheet 19 protruding from the MFD 1 is decreased. This makes the recording sheet 19 difficult to be hung from the MFD 1, so that the recording sheet 19 is restrained from remaining curved.

Modified Example 2 of First Embodiment

In the illustrated embodiment, the attribute of the recording sheet 19 is information about the length of the recording sheet 19 in the first direction 15, but the attribute of the recording sheet 19 may be other information. For example, the attribute of the recording sheet 19 may be an amount of ink (an example of a recording material) ejected from the recording head 64 and ejected to the recording sheet 19 during the image recording.

The amount of ink ejected to the recording sheet 19 is, for example, calculated as follows. The controller 130 references print data transmitted from the external information device such as a computer. More precisely, kinds of the ink droplets ejected during the image recording and ejection numbers of times corresponding to the kinds of the ink droplets (as a density is larger, the ejection number of times is increased) are determined according to respective positions (respective dots) on the image-recording face of the recording sheet 19. The controller 130 calculates respective values of four colors of ink droplets multiplied by the corresponding ejection numbers of times and adds up the calculated four values. Accordingly, the amount of ink ejected to the recording sheet 19, i.e., the amount of ink ejected to the piece of recording sheet 19 on which all parts of image have been recorded by the recording portion 24 is calculated. The above-calculated amount of ink is stored in the RAM 133. The RAM 133 is an example of a recording-material-amount storage.

At least one of the ROM 132 and the EEPROM 134 stores a plurality of amounts of ink and respective stopping positions of the recording sheet 19 corresponding to the plurality of amounts of ink. The attribute (the amount of ink) and the stopping position are stored, e.g., in the form of the data table. The data table is structured such that, as the amount of ink increases, the stopping position is located on more upstream side in the first direction 15. In the data table in the present example 2, as shown in FIG. 10C, the position P1 is stored as the stopping position of the recording sheet 19 in a case where the amount of ink is smaller than a first threshold, while a position P3 that is located on an upstream side of the position P1 in the first direction 15 is stored as the stopping position of the recording sheet 19 in a case where the amount of ink is equal to or greater than the first threshold.

In the present embodiment, the first threshold (corresponding to a predetermined threshold) is a predetermined amount for the purpose of judging whether the recording sheet 19 is easily kept curved. In other words, in a case where the amount of ink is equal to or greater than the first threshold, the recording sheet 19 is easily kept curved. Further, the position P3 is a position of the upstream end of the recording sheet 19 in the first direction 15 when the recording sheet 19 is stopped after the image recording thereon is completed. The position P3 is located on an upstream side of at least one of the positions P1, P2 in the first direction 15. A position of the recording sheet 19 in a case where the upstream end of the recording sheet 19 in the first direction 15 is positioned at the position P3 (the position of the recording sheet 19, hereinafter, referred to as a third position) is an example of an upstream-side stopping position. As mentioned above, at least one of the ROM 132 and the EEPROM 134 is an example of a stopping-position storage.

Hereinafter, a processing procedure of a stop control in the modified example 2 will be explained with reference to a flow chart of FIG. 6. In a description below, only processing different from the flow charts of FIGS. 4 and 5 will be described, and a detailed description of processing identical with the flow charts of FIGS. 4 and 5 will be omitted.

Figure 6:
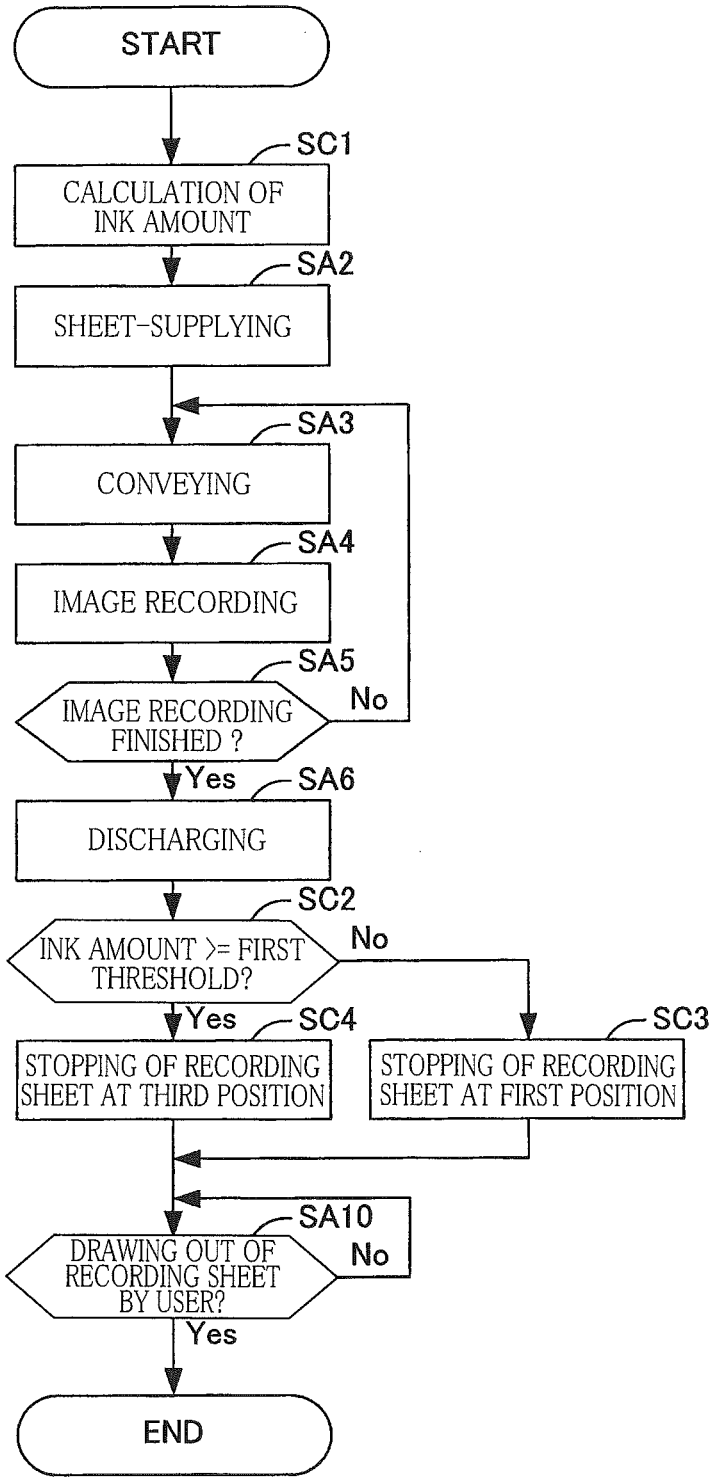
FIG. 6 is a flow chart for explaining a stop control in a modified example 2 of the first embodiment.

When the user inputs a command to the MFD 1 via the operation panel 4 that the image recording should be performed on the recording sheet 19 accommodated in the sheet-supply tray 20, the controller 130 starts executing the process in the flow chart shown in FIG. 6. First, the controller 130, based on the print data, calculates the amount of ink to be ejected to the recording sheet 19 on which the image recording is going to be performed (SC1). Information about the calculated amount of ink is stored in the RAM 133.

After the discharge operation of the recording sheet 19 is performed (SA6), the controller 130 collates the amount of ink calculated in SC1 and stored in the RAM 133 with the data table shown in FIG. 10C. In a case where the amount of ink is smaller than the first threshold (SC2: NO), the controller 130 stops the recording sheet 19 at the first position (SC3). On the other hand, in a case where the amount of ink is equal to or greater than the first threshold (SC2: YES), the controller 130 stops the recording sheet 19 at the third position (SC4). As mentioned above, processing of SC2 through SC4 is an example of a controller. In the modified example 2, in the case where the amount of ink is smaller than the first threshold, the recording sheet 19 is stopped at the first position, but the recording sheet 19 may be stopped at the second position. In the case where the recording sheet 19 is stopped at the first position in the case where the amount of ink is smaller than the first threshold, the third position is located on the upstream side of the first position in the first direction 15, and in the case where the recording sheet 19 is stopped at the second position in the case where the amount of ink is smaller than the first threshold, the third position is located on the upstream side of the second position in the first direction 15.

Hereinafter, an effect of the modified example 2 will be explained. As the amount of ink ejected to the recording sheet 19 is relatively larger, the weight of the recording sheet 19 becomes larger. Consequently, a portion of the recording sheet 19 protruding from the MFD 1 is easily hung from the MFD1 so as to remain curved. In the modified example 2, because the recording sheet 19 to which relatively large amount of ink is ejected is stopped at the third position, a portion of the recording sheet 19 protruding from the MFD 1 is reduced. As a result, the recording sheet 19 is difficult to be hung from the MFD 1, so that the recording sheet 19 is restrained from remaining curved.

In the modified example 2, the amount of ink is calculated by the controller 130 (SC1) right after the stop control illustrated in the flow chart of FIG. 6 is started. Instead of this, for example, the controller 130 may accumulate (cumulate) the amount of ink ejected every time the image recording is performed (SA4) and the accumulated amount of ink at the time when the image recording is ended (SA5: YES) may be stored in the RAM 133.

Second Embodiment

The controller 130 may stop the recording sheet 19 after the image recording at a fourth position (an example of a post-recording stopping position) and, in a case where more than a first period of time (an example of a nipping-stopping time) has passed in a state in which the recording sheet 19 is stopped at the fourth position, the controller 130 may convey the recording sheet 19 to a fifth position (an example of a post-stopping stopping position) different from the fourth position.

The fourth position is, similarly to the first position through the third position, a position where the recording sheet 19 on which the image recording has been completed is stopped in a state of being nipped by the discharge rollers 55. In other words, when the recording sheet 19 is stopped at the fourth position, a downstream end of the recording sheet 19 in the first direction 15 (the leading end of the recording sheet in the first direction 15) is located on the downstream side of the nipping position of the recording sheet 19 by the discharge rollers 55 in the first direction 15. Further, when the recording sheet 19 is stopped at the fourth position, the upstream end of the recording sheet 19 in the first direction 15 (the trailing end of the recording sheet 19 in the first direction 15) is located on the upstream side of the nipping position of the recording sheet 19 by the discharge rollers 55 in the first direction 15. The fourth position may be identical with one of the first position through the third position or may be different from the first position through the third position.

Furthermore, the fifth position is, similarly to the fourth position, a position where the recording sheet 19 on which the image recording has been completed is stopped in the state of being nipped by the discharge rollers 55. The fifth position is different from the fourth position. The fifth position may be located on an upstream side or a downstream side of the fourth position in the first direction 15.

Moreover, the first period of time is a predetermined period of time for the purpose of judging whether there is a possibility that the nipping position of the recording sheet 19 by the discharge rollers 55 is kept curved. In other words, when more than the first period of time has passed since the recording sheet 19 is stopped in the state of being nipped by the discharge rollers 55, it is possible that the nipping position of the recording sheet 19 is kept curved.

The controller 130 in the second embodiment includes a count circuit to count a period of time in order to judge an elapse of the first period of time. The count circuit is, for example, constituted as a part of the ASIC 135. Instead of the count circuit, to count a period of time may be realized by the program stored in the ROM 132, i.e., software.

Hereinafter, a processing procedure of a stop control in the second embodiment will be explained with reference to a flow chart of FIG. 7. In a description below, only processing different from the flow charts of FIGS. 4 through 6 will be described, and a detailed description of processing identical with the flow charts of FIGS. 4 through 6 will be omitted.

Figure 7:
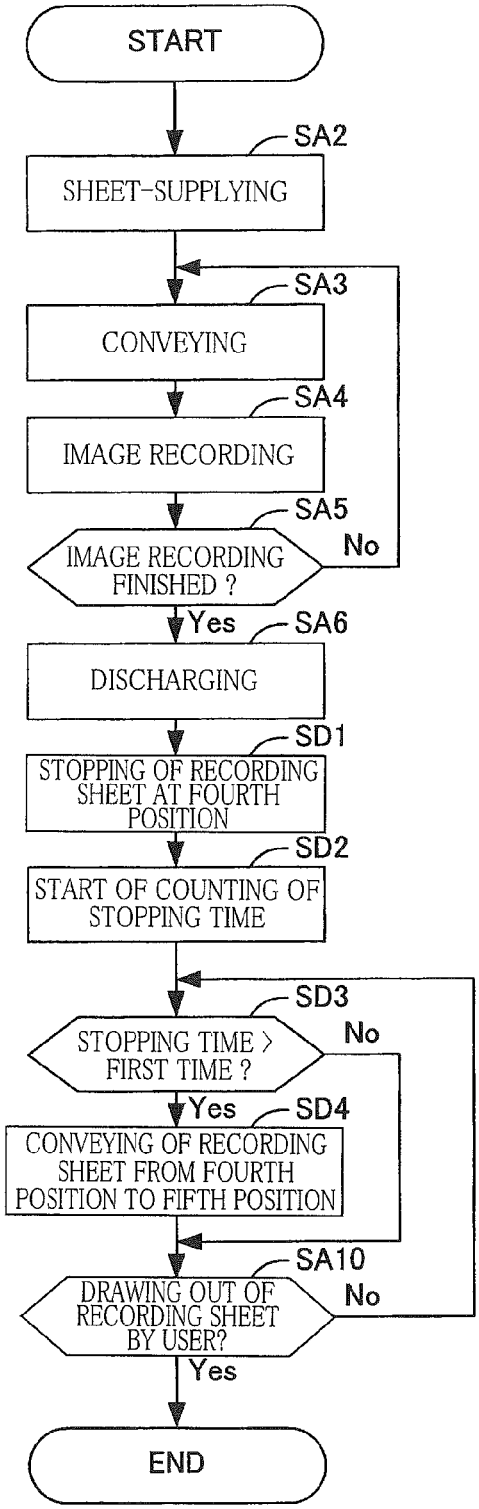
FIG. 7 is a flow chart for explaining a stop control in a second embodiment.

When the user inputs the command to the MFD 1 via the operation panel 4 that the image recording should be performed on the recording sheet 19 accommodated in the sheet-supply tray 20, the controller 130 starts executing the process in the flow chart shown in FIG. 7. In the second embodiment, step SA1 illustrated in the flow charts of FIGS. 4 through 6 is not implemented. After the discharge operation of the recording sheet 19 is performed (SA6), the controller 130 stops the recording sheet 19 at the fourth position (SD1). Processing of SD1 is an example of a controller.

The controller 130 starts to count a period of time by the count circuit at the same time as stopping of the recording sheet 19 at the fourth position (SD2). An amount of count by the count circuit is a stopping period of time of the recording sheet 19 at the fourth position and an elapsing period of time since the recording sheet 19 is stopped at the fourth position, i.e., since the drive of the conveyor roller 47 and the discharge roller 49 is stopped.

In a case where the stopping period of time does not exceed the first period of time (SD3: NO), the controller 130 implements a judgment of SA10. On the other hand, in a case where the stopping period of time is greater than the first period of time (SD3: YES), the controller 130 conveys the recording sheet 19 from the fourth position to the fifth position (SD4). The recording sheet 19 is thus stopped at the fifth position. Processing of SD3 and SD4 is an example of a controller. In the case where the stopping period of time is greater than the first period of time and SD4 is implemented, the count circuit is reset.

Hereinafter, an effect of the second embodiment will be explained. In a case where the recording sheet 19 continues to be in a state of being stopped and nipped by the discharge rollers 55, there is a possibility that the nipping position of the recording sheet 19 by the discharge rollers 55 is kept curved. In the second embodiment, in a case where the recording sheet 19 continues to be in the state of being stopped and nipped by the discharge rollers 55 for more than the first period of time, the recording sheet 19 is conveyed such that a position of the recording sheet 19 is changed from the fourth position to the fifth position. Accordingly, the nipping position of the recording sheet 19 by the discharge rollers 55 is changed. Consequently, the recording sheet 19 is restrained from remaining curved due to a nipping of the recording sheet 19 by the discharge rollers 55.

Modified Example 1 of Second Embodiment

The controller 130 may change a stopping period of time of the recording sheet 19 before a start of implementing of SD4, based on an amount of ink ejected to the nipping position of the recording sheet 19 by the discharge rollers 55.

Hereinafter, a processing procedure of a stop control in a modified example 1 of the second embodiment will be explained with reference to a flow chart of FIG. 8. In a description below, only processing different from the flow charts of FIGS. 4 through 7 will be described, and a detailed description of processing identical with the flow charts of FIGS. 4 through 7 will be omitted.

Figure 8:
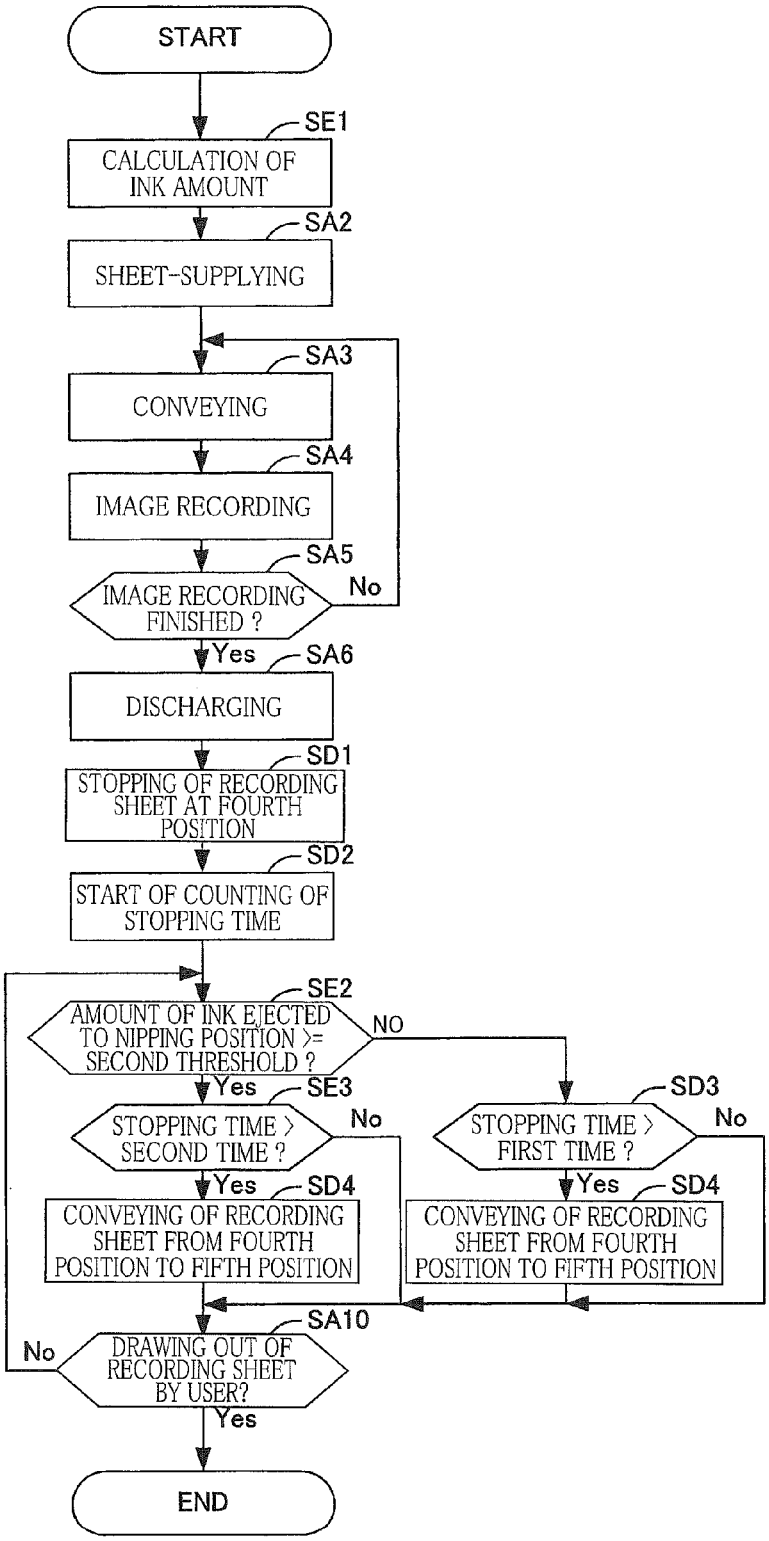
FIG. 8 is a flow chart for explaining a stop control in a modified example 1 of the second embodiment.

When the user inputs the command to the MFD 1 via the operation panel 4 that the image recording should be performed on the recording sheet 19 accommodated in the sheet-supply tray 20, the controller 130 starts executing the process in the flow chart shown in FIG. 8. When the stop control starts to be executed, the controller 130, based on the signals inputted from the optical sensors 60, 121, calculates a nipping position of the recording sheet 19 nipped by the discharge rollers 55 in the first direction 15 in a state in which the upstream end of the recording sheet 19 in the first direction 15 is stopped at the fourth position. The controller 130 calculates an amount of ink (hereinafter, referred to as an amount of ink ejected to the nipping position) ejected to a prescribed area which consists of the calculated nipping position and a position adjacent to the nipping position in such a manner explained in the modified example 2 of the first embodiment. The calculated amount of ink ejected to the nipping position of the recording sheet 19 is stored in the RAM 133 (SE1). The RAM 133 is an example of a partial-amount storage.

After counting of the stopping period of time by the count circuit is started (SD2), the controller 130 judges whether the amount of ink stored in the RAM 133 is equal to or greater than a second threshold (SE2). The second threshold (an example of a partial-amount threshold) is a predetermined amount for the purpose of judging whether the recording sheet 19 at the nipping position easily remains curved. In other words, in a case where the amount of ink ejected to the nipping position of the recording sheet 19 is equal to or greater than the second threshold, the recording sheet 19 is easy to remain curved at the nipping position thereof.

In a case where the amount of ink stored in the RAM 133 is smaller than the second threshold (SE2: NO), processing similar to SD3 and SD4 described above is implemented. On the other hand, in a case where the amount of ink stored in the RAM 133 is equal to or greater than the second threshold (SE2: YES), the controller 130 judges whether the stopping period of time of the recording sheet 19 at the fourth position is greater than a second period of time (an example of a predetermined time) (SE3). The second period of time is a predetermined period of time that is shorter than the first period of time. In a case where the stopping period of time of the recording sheet 19 at the fourth position is greater than the second period of time (SE3: YES), the controller 130 conveys the recording sheet 19 from the fourth position to the fifth position (SD4). Accordingly, the recording sheet 19 is stopped at the fifth position. Processing of SE2, SE3, SD3 and SD4 in FIG. 8 is an example of a controller.

Hereinafter, an effect of the modified example 1 of the second embodiment will be explained. In a state in which the recording sheet 19 is stopped by the discharge rollers 55, in a case where the amount of ink ejected to the nipping position of the recording sheet 19 by the discharge rollers 55 is large, a bend or a curve at the nipping position of the recording sheet 19 occurs for a shorter period of time compared to a case where the amount of ink is small. In the modified example 1 of the second embodiment, in a case where the amount of ink ejected to the nipping position of the recording sheet 19 is relatively large, a stopping position of the recording sheet 19 is changed from the fourth position to the fifth position after an elapse of the second period of time that is shorter than the first period of time. Therefore, in the case where the amount of ink ejected to the nipping position of the recording sheet 19 by the discharge rollers 55 is large, the recording sheet 19 is restrained from remaining curved.

Modified Example 2 of Second Embodiment

In the modified example 1 of the second embodiment, the controller 130 changes the stopping period of time of the recording sheet 19 before implementing of SD4 starts based on the amount of ink ejected to the nipping position of the recording sheet 19. The controller 130 may change the stopping period of time of the recording sheet 19 before implementing of SD4 starts, based on an amount of ink ejected to a contact position between the sheet-discharge tray 21 and the recording sheet 19, instead of the nipping position.

The contact position (an example of a contact position) is a position indicated by a reference numeral 16 in FIG. 2. The recording sheet 19 nipped by the discharge rollers 55 at a position close to the upstream end thereof in the first direction 15 is in a state indicated by a two-dot chain line in FIG. 2. In other words, a downstream end portion of the recording sheet 19 in the first direction 15 is in a state of being hung from a front end of the sheet-discharge tray 21. In this state, the recording sheet 19 in a state of being curved is held in contact with the front end of the sheet-discharge tray 21 at the contact position.

Hereinafter, a processing procedure of a stop control in a modified example 2 of the second embodiment will be explained with reference to a flow chart of FIG. 9. In a description below, only processing different from the flow charts of FIGS. 4 through 8 will be described, and a detailed description of processing identical with the flow charts of FIGS. 4 through 8 will be omitted.

Figure 9:
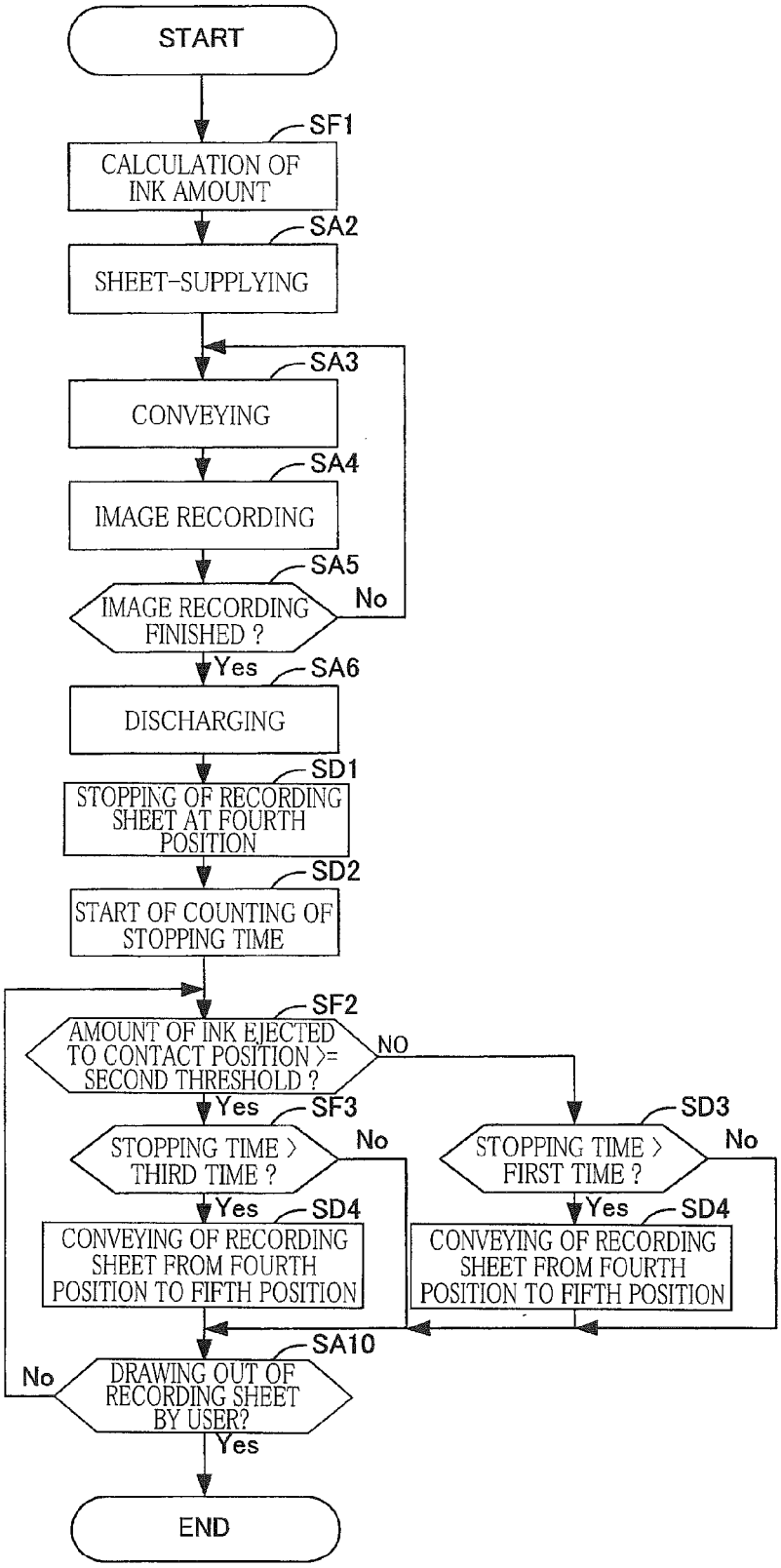
FIG. 9 is a flow chart for explaining a stop control in a modified example 2 of the second embodiment.

When the user inputs the command to the MFD 1 via the operation panel 4 that the image recording should be performed on the recording sheet 19 accommodated in the sheet-supply tray 20, the controller 130 starts an execution of the stop control illustrated in the flow chart of FIG. 9. When the execution of the stop control starts, the controller 130, based on the signals inputted from the optical sensors 60, 121, calculates a position where the stopped recording sheet 19 is held in contact with the front end of the sheet-discharge tray 21, i.e., the contact position 16. The controller 130 calculates an amount of ink (hereinafter, referred to as an amount of ink ejected to the contact position) ejected to a prescribed area which consists of the calculated contact position 16 and a position adjacent to the contact position 16 in the manner explained in the modified example 2 of the first embodiment. The calculated amount of ink ejected to the contact position is stored in the RAM 133 (SF1). The RAM 133 is an example of a partial-amount storage.

After counting of the stopping period of time by the count circuit starts (SD2), the controller 130 judges whether the amount of ink stored in the RAM 133 is equal to or greater than a third threshold (SF2). The third threshold (an example of a partial amount threshold) is a predetermined amount for the purpose of judging whether the recording sheet 19 at the contact position 16 easily remains curved. In other words, in a case where the amount of ink ejected to the contact position 16 is equal to or greater than the third threshold, the recording sheet 19 is easy to remain curved at the contact position 16.

In a case where the amount of ink stored in the RAM 133 is smaller than the third threshold (SF2: NO), processing similar to SD3 and SD4 described above is implemented. On the other hand, in a case where the amount of ink stored in the RAM 133 is equal to or greater than the third threshold (SF2: YES), the controller 130 judges whether the stopping period of time of the recording sheet 19 at the fourth position is greater than a third period of time (an example of a predetermined time) (SF3). The third period of time is a predetermined period of time that is shorter than the first period of time. The third period of time may be identical with, shorter than or longer than the second period of time. In a case where the stopping period of time of the recording sheet 19 at the fourth position is greater than the third period of time (SF3: YES), the controller 130 conveys the recording sheet 19 from the fourth position to the fifth position (SD4). Accordingly, the recording sheet 19 is stopped at the fifth position. Processing of SF2, SF3, SD3 and SD4 is an example of a controller.

Hereinafter, an effect of the modified example 2 of the second embodiment will be explained. In a case where the recording sheet 19 protrudes from the MFD 1, the recording sheet 19 is in contact with a front end portion of the sheet-discharge tray 21 so as to be curved at the contact position 16 thereof. In this case, in a case where the amount of ink ejected to the contact position 16 of the recording sheet 19 with the sheet-discharge tray 21 is relatively large, a bend or a curve of the contact position 16 of the recording sheet 19 occurs for a shorter period of time compared to a case where the amount of ink is small. In the modified example 2 of the second embodiment, in a case where the amount of ink ejected to the contact position 16 of the recording sheet 19 is relatively large, a stopping position of the recording sheet 19 is changed from the fourth position to the fifth position after an elapse of the third period of time that is shorter than the first period of time. Therefore, in the case where the amount of ink ejected to the contact position 16 of the recording sheet 19 with the sheet-discharge tray 21 is large, the recording sheet 19 is restrained from remaining curved.

In the modified examples 1, 2 of the second embodiment, the calculation of the amount of ink by the controller 130 (SE1, SF1) is performed right after the stop control illustrated in the flow charts of FIGS. 8 and 9 starts. However, instead of this, for example, the controller 130 may accumulate the amount of ink when the ink is ejected to the nipping position or the contact position of the recording sheet 19 in the state in which the upstream end of the recording sheet 19 in the first direction 15 is stopped at the fourth position. The accumulated amount of ink may be stored in the RAM 133.

In the respective modified examples 1, 2 of the first and the second embodiments, it is preferable that the first through the fifth positions are located on a downstream side in the first direction 15 of a most downstream one of the plurality of nozzles formed in the recording head 65 in the first direction 15. This is due to the following reason. When the recording sheet 19 is stopped in the state of being nipped by the discharge rollers 55, there is a possibility that the upstream end of the recording sheet 19 in the first direction 15 moves upward. In this case, the nozzles 64 from which ink is ejected comes into contact with the recording sheet 19, so that it is possible that the recording sheet 19 on which the image recording has been completed is contaminated. Therefore, it is preferable that the first through the fifth positions are located on the downstream side in the first direction 15 of the most downstream one of the plurality of nozzles of the recording head 65 in the first direction 15.

What is claimed is:

1. An image recording apparatus, comprising:

a recording portion configured to record an image on a sheet conveyed through a conveying path in a conveying direction by ejecting recording material to the sheet;

a sheet conveyor disposed at a downstream side of the recording portion in the conveying direction and configured to convey the sheet in the conveying direction while nipping the sheet;

a detector configured to detect a position of the sheet conveyed through the conveying path; and a controller configured to:

in a case where all parts of the image have been recorded on a first-attribute sheet which has a first attribute, control the sheet conveyor to stop the first-attribute sheet in a state in which the sheet conveyor is nipping the first-attribute sheet when the detector has detected that the first-attribute sheet reaches a first-attribute-sheet stopping position where the-first-attribute sheet is to be stopped after all parts of the image have been recorded thereon;

in a case where all parts of the image have been recorded on a second-attribute sheet which has a second attribute, control the sheet conveyor to stop the second-attribute sheet in a state in which the sheet conveyor is nipping the second-attribute sheet when the detector has detected that the second-attribute sheet reaches a second-attribute-sheet stopping position where the second-attribute sheet is to be stopped after all parts of the image have been recorded thereon, the second-attribute-sheet stopping position being located on an upstream side of the first-attribute-sheet stopping position in the conveying direction;

control the sheet conveyor to stop conveying the first-attribute-sheet when an upstream end of the first-attribute-sheet in the conveying direction reaches the first-attribute-sheet stopping position which is located on an upstream side of the sheet conveyor in the conveying direction; and control the sheet conveyor to stop conveying the second-attribute-sheet when an upstream end of the second-attribute-sheet in the conveying direction reaches the second-attribute-sheet stopping position.

2. The image recording apparatus according to claim 1, wherein the controller is configured to:

in a case where an amount of recording material to be ejected to the sheet on which all arts of the image have been recorded is smaller than a predetermined threshold, stop the sheet on which all parts of the image have been recorded to be positioned at one of the first-attribute-sheet stopping position and the second-attribute-sheet stopping position; and in a case where the amount of the recording material ejected to the sheet is equal to or greater than the predetermined threshold, stop the sheet on which all parts of the image have been recorded to reach an upstream-side stopping position where the sheet is to be stopped and which is located on an upstream side of the one of the first-attribute-sheet stopping position and the second-attribute-sheet stopping position in the conveying direction while the sheet conveyor is nipping the sheet.

3. The image recording apparatus according to claim 1, wherein the first attribute indicates a first length of the sheet in the conveying direction and the second attribute indicates a second length of the sheet in the conveying direction, and the first length is smaller than the second length.

4. The image recording apparatus according to claim 1, wherein the first attribute indicates a first weight of the sheet per unit area and the second attribute indicates a second weight of the sheet per unit area, and the first weight is smaller than the second weight.

5. The image recording apparatus according to claim 1, wherein the recording portion includes a recording head and a plurality of nozzles formed in the recording head in the conveying direction and from which recording material is ejected, and wherein the first-attribute-sheet stopping position and the second-attribute-sheet stopping position are located on a downstream side of a most downstream one of the plurality of nozzles in the conveying direction.

6. An image recording apparatus, comprising:

a recording portion configured to record an image on a sheet conveyed through a conveying path in a conveying direction by ejecting recording material to the sheet;

a sheet conveyor disposed at a downstream side of the recording portion in the conveying direction and configured to convey the sheet in the conveying direction while nipping the sheet;

a detector configured to detect a position of the sheet conveyed through the conveying path;

a controller configured to:

in a case where all parts of the image have been recorded on a first-attribute sheet which has a first attribute, control the sheet conveyor to stop the first-attribute sheet in a state in which the sheet conveyor is nipping the first-attribute sheet when the detector has detected that the first-attribute sheet reaches a first-attribute-sheet stopping position where the-first-attribute sheet is to be stopped after all parts of the image have been recorded thereon; and, in a case where all parts of the image have been recorded on a second-attribute sheet which has a second attribute, control the sheet conveyor to stop the second-attribute sheet in a state in which the sheet conveyor is nipping the second-attribute sheet when the detector has detected that the second-attribute sheet reaches a second-attribute-sheet stopping position where the second-attribute sheet is to be stopped after all parts of the image have been recorded thereon, the second-attribute-sheet stopping position being located on an upstream side of the first-attribute-sheet stopping position in the conveying direction;

an attribute-storage configured to store the first attribute and the second attribute; and a stopping-position storage configured to store the first-attribute-sheet stopping position and the second-attribute-sheet stopping position, and wherein the controller is further configured to:

in a case where the attribute-storage stores the first attribute of the first-attribute sheet, control the sheet conveyor to stop conveying the first-attribute sheet when the detector has detected that the first-attribute sheet reaches the first-attribute-sheet stopping position read from the stopping-position storage; and in a case where the attribute-storage stores the second attribute of the second-attribute sheet, control the sheet conveyor to stop conveying the second-attribute sheet when the detector has detected that the second-attribute sheet reaches the second-attribute-sheet stopping position read from the stopping-position storage.

7. The image recording apparatus according to claim 6, wherein the controller is configured to:

control the sheet conveyor to stop conveying the first-attribute sheet when the detector has detected that an upstream end of the first-attribute-sheet in the conveying direction reaches the first-attribute-sheet stopping position which is located on an upstream side of the sheet conveyor in the conveying direction; and control the sheet conveyor to stop conveying the second-attribute sheet when the detector has detected that an upstream end of the second-attribute-sheet in the conveying direction reaches the second-attribute-sheet stopping position.

8. The image recording apparatus according to claim 6, wherein the attribute-storage is configured to store information about a first length of the sheet in the conveying direction of the first attribute and a second length of the sheet in the conveying direction of the second attribute, and wherein the first length is smaller than the second length.

9. The image recording apparatus according to claim 6, wherein the attribute-storage is configured to store information about a first weight of the sheet per unit area as the first attribute and a second weight of the sheet per unit area as the second attribute, and wherein the first weight is smaller than the second weight.

10. The image recording apparatus according to claim 6, further comprising a recording-material-amount storage configured to store an amount of recording material ejected to the sheet after all parts of the image have been recorded thereon by the recording portion, wherein the stopping-position storage is configured to store an upstream-side stopping position where the sheet is to be stopped and which is located on an upstream side of at least one of the first-attribute-sheet stopping position and the second-attribute-sheet stopping position in the conveying direction, and wherein the controller is configured to:

in a case where the recording-material-amount storage stores that the amount of the recording material ejected to the sheet is smaller than a predetermined threshold, control the sheet conveyor to stop conveying the sheet in a state in which the sheet on which all parts of the image have been recorded to be positioned at one of the first-attribute-sheet stopping position and the second-attribute-sheet stopping position, and in a case where the recording-material-amount storage stores that the amount of the recording material ejected to the sheet is equal to or greater than the predetermined threshold, control the sheet conveyor to stop conveying the sheet in a state in which the sheet on which all parts of the image have been recorded to be positioned at the upstream-side stopping position stored in the stopping-position storage.

* * * * *